US010442096B2

(12) United States Patent
Kemos et al.

(10) Patent No.: US 10,442,096 B2
(45) Date of Patent: Oct. 15, 2019

(54) METHOD OF MANUFACTURING A RAZOR HEAD COMPONENT

(71) Applicant: BIC VIOLEX S.A., Anixi (GR)

(72) Inventors: George Kemos, Athens (GR); Dimitris Pissimissis, Athens (GR)

(73) Assignee: BIC VIOLEX S.A., Anixi (GR)

( * ) Notice: Subject to any disclaimer, the term of this patent is extended or adjusted under 35 U.S.C. 154(b) by 160 days.

(21) Appl. No.: 14/988,915

(22) Filed: Jan. 6, 2016

(65) Prior Publication Data

US 2016/0114493 A1 Apr. 28, 2016

Related U.S. Application Data

(63) Continuation of application No. 13/264,629, filed as application No. PCT/EP2009/054454 on Apr. 15, 2009, now Pat. No. 9,289,909.

(51) Int. Cl.

| | |
|---|---|
| ***B26B 21/40*** | (2006.01) |
| ***B21D 53/64*** | (2006.01) |
| ***B26B 21/22*** | (2006.01) |
| ***B26B 21/56*** | (2006.01) |

(52) U.S. Cl.

CPC ..... *B26B 21/4068* (2013.01); *B21D 53/645* (2013.01); *B26B 21/227* (2013.01); *B26B 21/4075* (2013.01); *B26B 21/565* (2013.01)

(58) Field of Classification Search

CPC ..... B26B 21/00; B26B 21/10; B26B 21/14; B26B 21/16; B26B 21/22; B26B 21/227; B26B 21/40; B26B 21/4068; B26B 21/4075

USPC ..... 30/47–51

See application file for complete search history.

(56) References Cited

U.S. PATENT DOCUMENTS

| | | | | | |
|---|---|---|---|---|---|
| 4,932,122 | A * | 6/1990 | Shurland | B26B 21/222 | 30/50 |
| 5,056,222 | A * | 10/1991 | Miller | B26B 21/227 | 30/47 |
| 5,067,238 | A * | 11/1991 | Miller | B26B 21/227 | 30/50 |
| 5,070,612 | A * | 12/1991 | Abatemarco | B26B 21/227 | 30/50 |
| 5,092,042 | A * | 3/1992 | Miller | B26B 21/4018 | 30/49 |
| 5,222,300 | A * | 6/1993 | Althaus | B26B 21/227 | 30/47 |
| 5,224,267 | A * | 7/1993 | Simms | B26B 21/227 | 30/50 |
| 5,416,974 | A * | 5/1995 | Wain | B26B 21/227 | 30/50 |
| 5,497,550 | A * | 3/1996 | Trotta | B26B 21/22 | 30/50 |

(Continued)

*Primary Examiner* — Jason Daniel Prone
(74) *Attorney, Agent, or Firm* — Polsinelli PC

(57) ABSTRACT

A method of manufacturing a razor head component that includes the steps of providing a strip of material elongated along a first direction (X), the strip having first and second rounded extremities parallel with the first direction (X). The strip includes a first portion having a first extremity, a second portion having a second extremity, and an intermediate portion intermediate the first and second portions, bending the intermediate portion of at least a part of the strip about a bending axis, and fixing a razor blade onto the second portion of the part.

15 Claims, 15 Drawing Sheets

(56) References Cited

U.S. PATENT DOCUMENTS

| | | | | |
|---|---|---|---|---|
| 6,009,624 | A * | 1/2000 | Apprille, Jr. | B26B 21/227 30/48 |
| 6,173,498 | B1 * | 1/2001 | Warrick | B26B 21/227 30/50 |
| 6,243,951 | B1 * | 6/2001 | Oldroyd | B26B 21/227 30/50 |
| 6,397,473 | B1 * | 6/2002 | Clark | B26B 21/227 30/50 |
| 7,111,401 | B2 * | 9/2006 | Richard | B26B 21/222 30/50 |
| 7,131,202 | B2 * | 11/2006 | Pennell | B26B 21/4031 30/50 |
| 8,327,545 | B2 * | 12/2012 | Peterson | B26B 21/22 30/50 |
| 9,289,909 | B2 * | 3/2016 | Kemos et al. | B21D 53/645 30/50 |
| 2007/0209206 | A1 * | 9/2007 | Van Eibergen Santhagens | B26B 21/222 30/50 |
| 2008/0066315 | A1 * | 3/2008 | Xu | B26B 21/565 30/50 |
| 2010/0154222 | A1 * | 6/2010 | Nakasuka | B26B 21/227 30/50 |
| 2010/0175265 | A1 * | 7/2010 | Bozikis | B26B 21/227 30/50 |
| 2011/0119922 | A1 * | 5/2011 | Ntavos | B26B 21/222 30/32 |
| 2011/0232100 | A1 * | 9/2011 | Park | B26B 21/28 30/50 |
| 2011/0289779 | A1 * | 12/2011 | Volodin | B26B 21/227 30/50 |
| 2012/0011725 | A1 * | 1/2012 | Gratsias | B26B 21/227 30/50 |

* cited by examiner

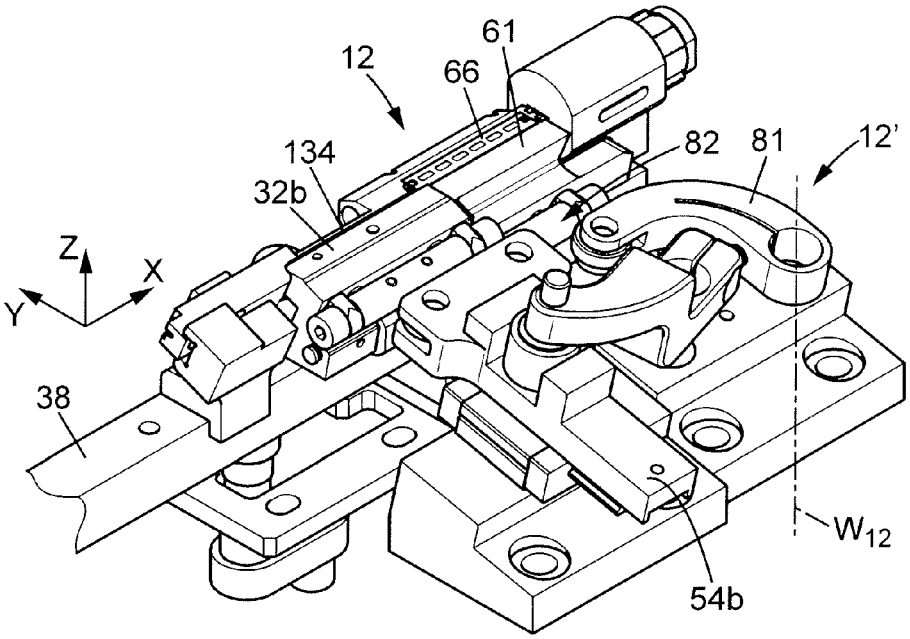
FIG. 12
FIG. 13
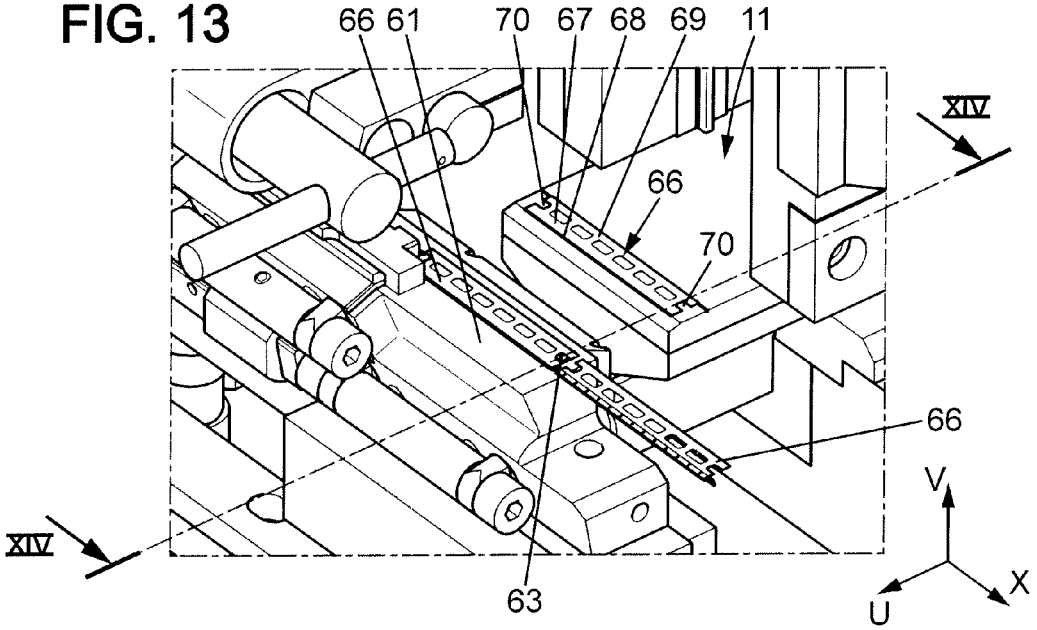

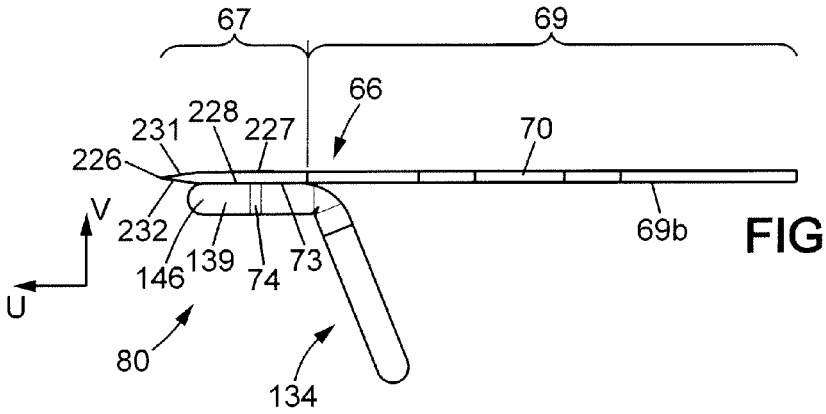
FIG. 25
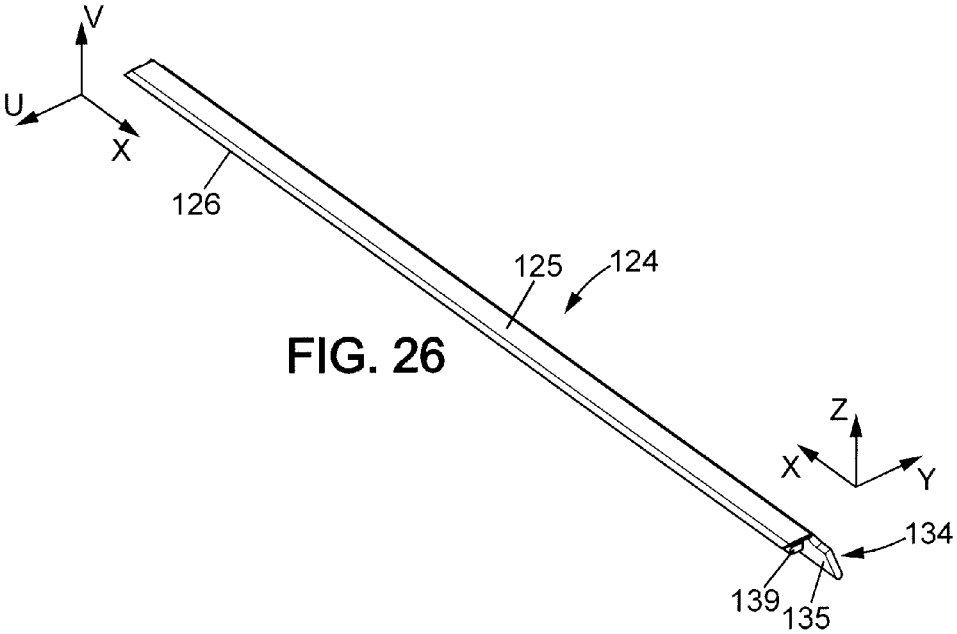
FIG. 26
FIG. 27
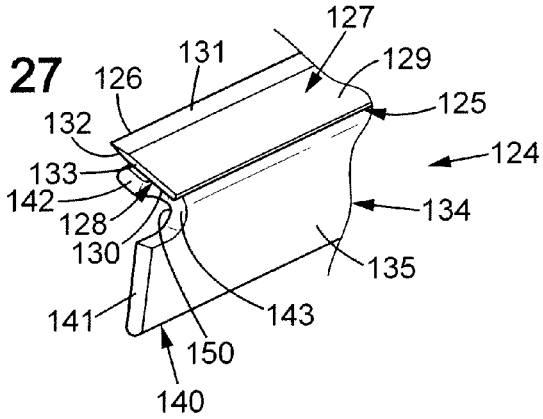

METHOD OF MANUFACTURING A RAZOR HEAD COMPONENT

CROSS REFERENCE TO RELATED APPLICATION

This application is a continuation of U.S. Pat. Ser. No. 9,289,909, filed on Oct. 14, 2011, which is a national stage application of International Application No. PCT/EP2009/054454, filed on Apr. 15, 2009, the entire contents of which are all incorporated herein by reference for all purposes.

FIELD OF THE INVENTION

The embodiments of the present invention relate to a razor cartridge and a mechanical razor that includes a cartridge. The embodiments of the present invention is also concerned with a method of manufacturing such a razor cartridge.

BACKGROUND OF THE INVENTION

In particular, the embodiments of the present invention relate to a razor cartridge that includes:

a housing, at least one support, received by the housing, and having parallel first and second faces, the support comprising a lower portion, an upper portion, and a bent portion intermediate the lower and upper portions, a razor blade comprising a cutting edge and a fixation portion fixed on the second face of the upper portion of the support.

WO 2007/147,420 describes such a razor head which has proven satisfactory.

However, one still strives to improve the performance of such shavers.

SUMMARY OF THE INVENTION

To this aim, a method of manufacturing a razor head component is provided, comprising the steps of:

(a) providing a strip of material elongated along a first direction, the strip having first and second rounded extremities parallel with the first direction, having a first portion comprising the first extremity, a second portion comprising the second extremity, and an intermediate portion intermediate the first and second portions, (b) bending the intermediate portion of at least a part of the strip about a bending axis, (c) fixing a razor blade onto the second portion of the part.

In some embodiments of the present invention, one might also use one or more of the features as defined in the dependent claims.

With these features, it is possible to provide a razor cartridge with improved performance for the user, in particular, improved feel and safety.

Advantages of some of the embodiments of the present invention are listed hereafter.

Through the use of supports having rounded end, for example, as a result of using flattened wire coils, one eliminates burrs on the extremities of the support structure which are generally the result of cutting operations. The absence of burrs allows a better and more precise fixation of the razor blade on the support, as there is no chance of the razor blade resting on a burr and thus modifying the inclination of the razor blade with respect to the flat plane of the support.

Furthermore, the absence of burrs is beneficial to the smooth transition and better alignment of supports in the assembling stations of the razor cartridge concerned with attaching the blade to the support.

Furthermore, the absence of burrs is beneficial to functionality of the support and razor blade assembly into the housing of the razor cartridge as it reduces the burrs getting pinned into plastic parts of the cartridge upon exertion of assembly force.

Furthermore, the provision of razor blade support elements obtained from flattened wire coils is beneficial to the overall manufacturing process and such coils have significantly less joint welds than traditional coils with rectangular cross-sections. This enables a marked reduction in downtime of the razor blade on the support assembly machine, as each joint weld requires stopping the machine and specific actions for production restart.

BRIEF DESCRIPTION OF THE DRAWINGS

Other characteristics and advantages of the invention will readily appear from the following description of one of its embodiments, provided as a non-limitative example, and of the accompanying drawings.

On the drawings:

FIG. 12 is another partial view of FIG. 9, FIG. 13 is a detailed view of FIG. 15, FIG. 25 is a lateral view of the assembly of a blade on a blade support at the bonding station, FIG. 26 is a perspective view of the blade and blade support assembly exiting the breaking station, FIG. 27 is a partial view of a blade and support assembly.

On the different Figures, the same reference signs designate like or similar elements.

DETAILED DESCRIPTION

Figure 1:
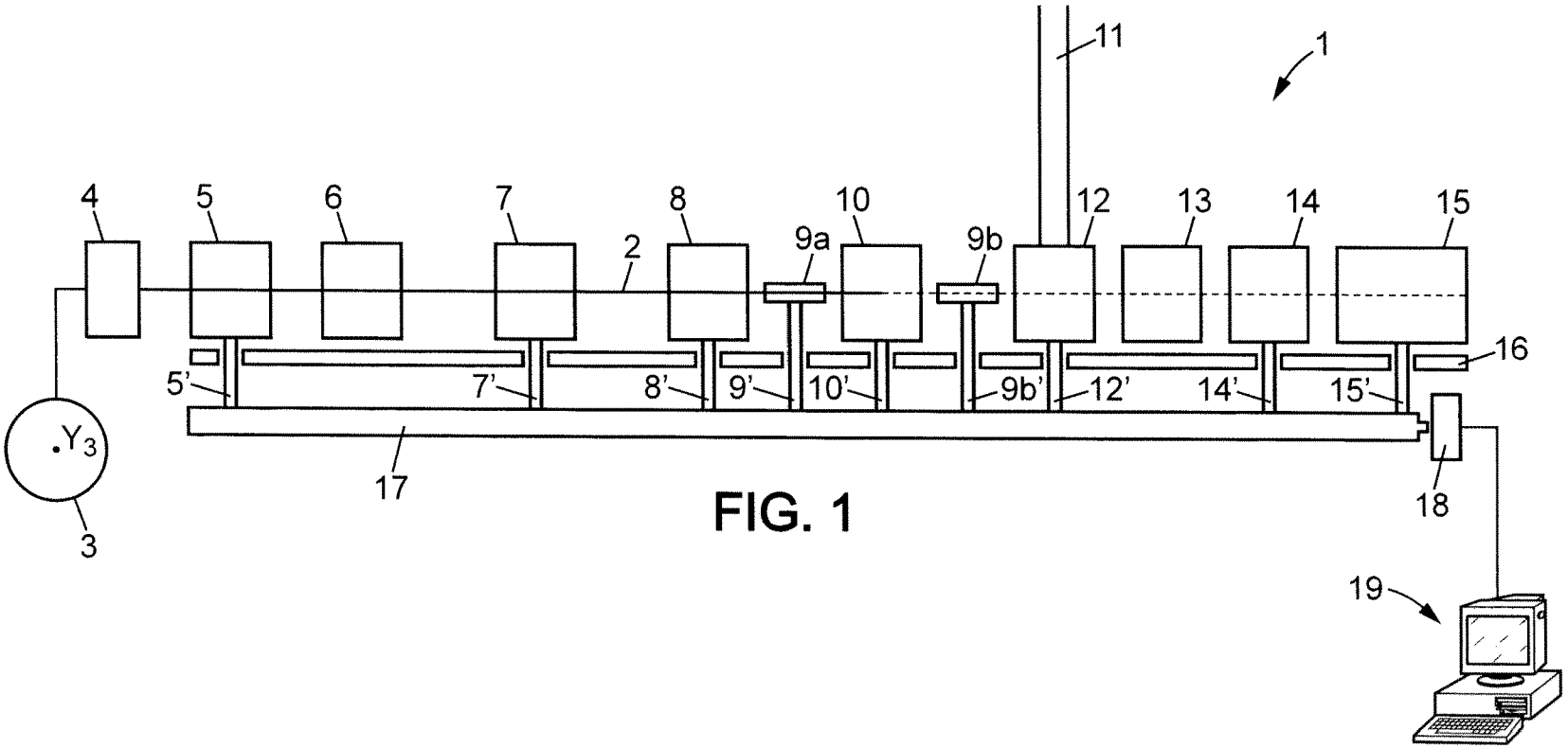
FIG. 1 is a schematic view of a manufacturing installation of a component according to a first embodiment.

FIG. 1 schematically shows a manufacturing apparatus 1 for the manufacture of an assembly of a blade and a blade support. Such an apparatus comprises a plurality of stations, which will be detailed thereafter, disposed along a path 2 materialized both by a straight line and dotted lines on FIG. 1, in particular a linear, and more particularly a rectilinear path for a blade support material.

In the present example, the apparatus 1 comprises a delivery station 3 which delivers an elongated strip of blade support material, and, disposed along the path 2 in this order, the following stations:

a loop control station 4, which is classical in this field, and is used to control the speed of delivery of the strip material by the delivery station, and will not be detailed more in the following, a groove forming station 5, adapted to form a longitudinal groove in the strip, and described in relation to FIG. 2, a strip straightening station 6, which is classical in this field, and which for example, comprises two rows of rollers having parallel rotational axis running in parallel with the support strip height, and spaced from one another transverse to this axis and transverse to the direction of movement of the strip, and rotated in contact with the faces of the strip to straighten it along its direction of movement, a notching station 7 adapted to perform notches in the strip (see FIGS. 3 and 4), a bending station 8, adapted to bend the strip (see FIGS. 5 and 6), a displacement station (see FIG. 7) comprising a first displacement post 9*a* (see FIG. 8), adapted to move the strip along the path, and a second displacement post 9*b* (see FIG. 10), adapted to displace individual supports along the path, a separation station 10 (see FIG. 7) adapted to separate individual supports from the strip and located between the first and second displacement posts 9*a*, 9*b*, a blade delivery station 11, adapted to deliver a blade in correspondence to a support (see FIG. 11), a blade assembly station 12 adapted to assemble a blade to a blade support (see FIGS. 12 and 13), a blade to blade support bonding station 13 adapted to firmly bond together the blade and the blade support (see FIG. 14), a breaking station 14, adapted to break a part of the blade (see FIG. 15), and an assembly staking station 15, adapted to form a stack of assemblies (see FIG. 15).

Most of these stations are disposed on a board 16 and are actuated by one or more respective actuators 5', 7', 8', 9*a*', 10', 9*b*', 12', 14', 15. For example, synchronization of the stations is ensured by connecting all these actuators to a common rotating shaft 17 driven by a servo-motor 18.

Further, although it is not visible on FIG. 1, inspection devices (for example optical sensors or the like) could be disposed in between stations so as to control the manufacturing process in specific stations. Such controls are connected to a remote monitoring station 19 such as for example, a micro computer, or the like, which also controls the operation of the motor 18. Some stations, such as for example, the bonding station, are not necessarily directly controlled by the shaft 17 but could be controlled directly by the monitoring station 19.

The delivery station 3 for example comprises a reel rotatable about a rotation axis Y3, and delivering a strip of material which is to become a blade support for a razor blade head.

Figure 18:
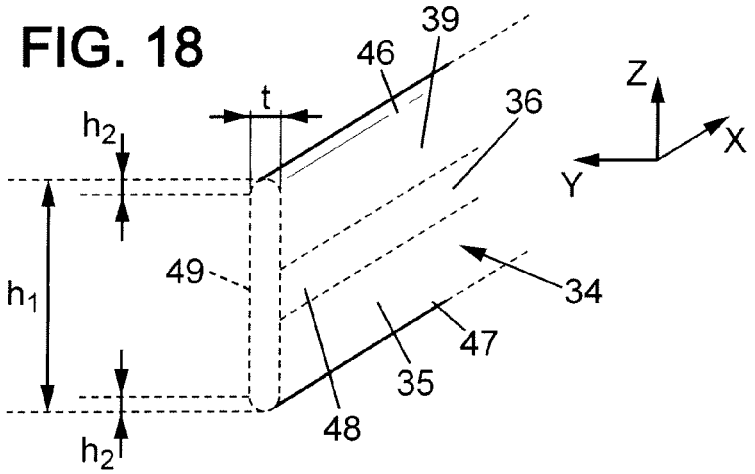

As shown on FIG. 18, the strip 34 is an elongated flat thin piece of rigid material, such as metal, in particular stainless steel, having the following composition (in chemical composition mass percentage):

C=[0.01; 0.3], and preferably [0.04; 0.12];
Cr=[10; 20], and preferably [16; 20];
Mn=[0; 8], and preferably [6; 7];
Ni=[0; 10], and preferably [4; 7];
N=[0; 0.5], and preferably [0; 0.25];
Si=[0; 2], and preferably [0.2; 0.5];
P=[0; 0.05], and preferably [0; 0.02];
S=[0; 0.05], and preferably [0; 0.01].

Such material has a hardness of about 150-300 HV1Kgf (preferably 200-250 HV1Kgf), a tensile strength of about 400-1000 MPa (preferably 800-950 MPa), a proof strength Rp 0.2% of 200-500 MPa (preferably 350-500 MPa), and an elongation at fracture of 20-60% (preferably 45-60%) .

This material can have specific benefits and advantages for its use for the manufacture of a blade support, which are not directly linked to the present invention. Further, other materials could be used within the scope of the convention.

For example, the strip was obtained by flattening a wire of appropriate size. In particular, the strip may be obtained by cold drawing rigid material to manufacture a wire, and subsequently cold rolling the wire to create a flattened wire strip having dimensions detailed below. Each of these manufacturing steps may be performed in one operation, or they can be divided in a number of sub-steps for gradual changes in cross-section, from a cylindrical shape to the shape of a rectangle with rounded extremities. The so-obtained strip 34 may further be annealed, before being slit to appropriate length (reel length).

When it comes to its geometric features, its thickness t (see FIG. 18) is about 0.28 mm (for example, comprised between 0.22 and 0.32 mm, preferably between 0.265 and 0.295) and its height hi of about 2.58 mm (for example comprised between 2.53 mm and 2.63 mm), and a dimension h2 of less than 0.15 mm. h2 represents the dimension of the rounded portion of the extremities 46, 47 of the strip 34 along the direction Z referred to as the height hi.

Figure 19:
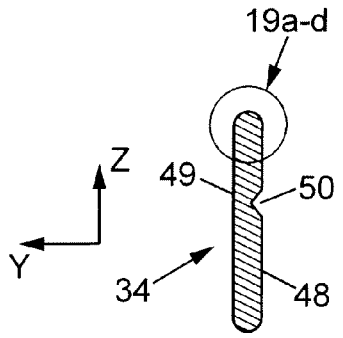
FIG. 19 is a schematic sectional view of the strip exiting the groove-forming station.
Figure 19A:
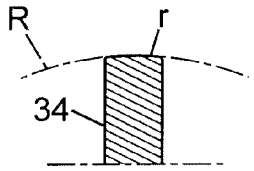
FIG. 19*a*, 19*b*, 19*c*, 19*d* are schematic views showing measurement of the radius of curvature of extremities.
Figure 19B:
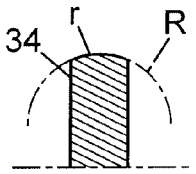
Figure 19C:
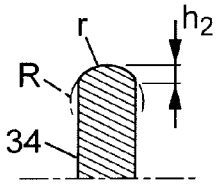

The radius of curvature r of the rounded extremities obtained from the flattening operation of the wire may be about 0.13 mm and 0.5 mm, measured from an imaginary arc R circumscribing the most points along the rounded extremity (see FIGS. 19*a-c*).

Such a strip 34 is entirely satisfactory for the present purpose.

However, in a variant of the present embodiment, it may be desirable to control more accurately the height hi of the strip, in particular if the flattening process along the thickness direction (cold rolling of the wire) cannot be sufficiently controlled to produce a strip having the required dimensions and tolerances, h1, h2, t.

In such a case, the flattened wire strip 34 may further be subjected to a flattening process along its height direction until the strip has appropriate and accurate height hi, h2 and thickness dimensions t.

Figure 19D:
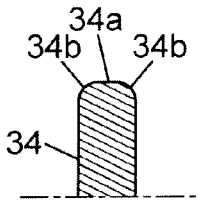

A strip 34 having undergone such a second flattening process may present a shape as illustrated in FIG. 19*d*, whereby each extremity 46, 47 comprises a flat portion 34*a* between rounded portions 34*b*. The flat portion 34*a* of the extremity results from a slight flattening of the rounded extremity 46, 47. Of course, the greater the height h1 after the first flattening process along its thickness direction, the greater will be the flattening in the second flattening process along its height direction, and therefore the greater the flat portion 34*a*.

In the following, the frame of reference X-Y-Z is used to describe the geometry of the strip. X designates the length (the elongation direction) of the strip, Y refers to the direction along which the strip is smallest (thickness direction) and Z corresponds to the third direction of the strip, which is referred to as the height. The frame of reference X-Y-Z is a local frame of reference attached to the strip and can, for example, turn in the global room frame of reference (not shown) if the strip is rotated in the room for example in between two stations.

As a flat thin material the strip can arbitrarily be divided along its height (along direction Z) in an upper portion 39, a lower portion 35 and an intermediate portion 36 between the upper 39 and lower 35 portions. The upper portion 39 extends from a top side 46 downwards, and the lower portion 35 extends from the bottom side 47 upwards. A strip 34 has two opposite faces 48, 49, opposed with respect to direction Y, and which, at this stage of the process can, for example, be undifferentiated.

The strip 34 is driven out of the delivery station 3 by continuous rotation of the reel, and by the stepwise movement of first displacement post 9*a*, as will be described in more details below. Thus, the strip passes through the loop control station 4, which is used to control the rotational speed of the reel 3. Then, the strip 34 passes through a groove forming station 5, details of which are shown on FIGS. 2 and 3.

Figure 2:
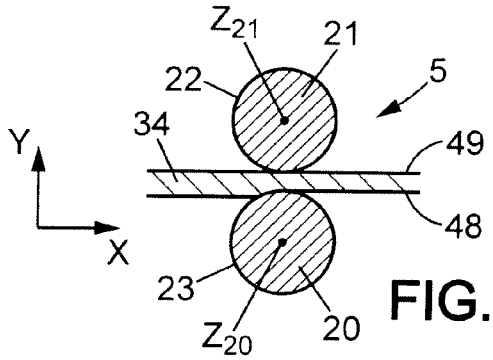
FIG. 2 is a schematic sectional view of a groove forming station of the apparatus of FIG. 1, taken along line II-II on FIG. 3.
Figure 3:
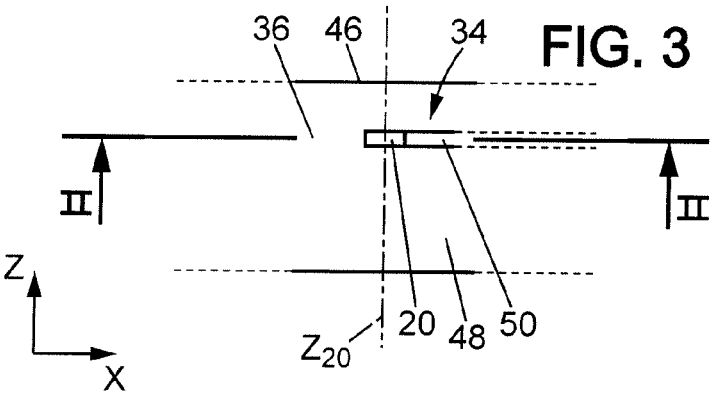
FIG. 3 is a lateral schematic view of the strip at a straightening station.

As shown on FIGS. 2 and 3, at the groove-forming station 5, the strip 34 is moved along longitudinal direction X between a groove forming roller 20 and a counter roller 21 which are disposed at the intermediate portion 36 of the strip and are controlled to rotate about the rotation axis Z20 and Z21, both parallel to the axis Z. Whereas the outer surface 22 simply bears on the face 49 of the strip, without deforming it, the outer surface 23 of the groove forming roller 20 is disposed so as to form a groove 50 in the face 48 of the strip 34 at the intermediate portion. The groove 50 is for example performed continuously and uninterruptedly in the strip 34 by material pressing. It can for example have a triangular cross-section, with symmetrical angled faces 501 and 502 with respect to a X-Y plane. Other geometries are possible. Material slitting is another groove-forming option.

The geometry of the strip exiting from the groove forming station 5 is schematically shown on FIG. 19, in section in the Y-Z plane.

The actuator 5' controls the movement of the groove forming station 5, and in particular the rotation of the roller 20 about the axis Z20.

Figure 4:
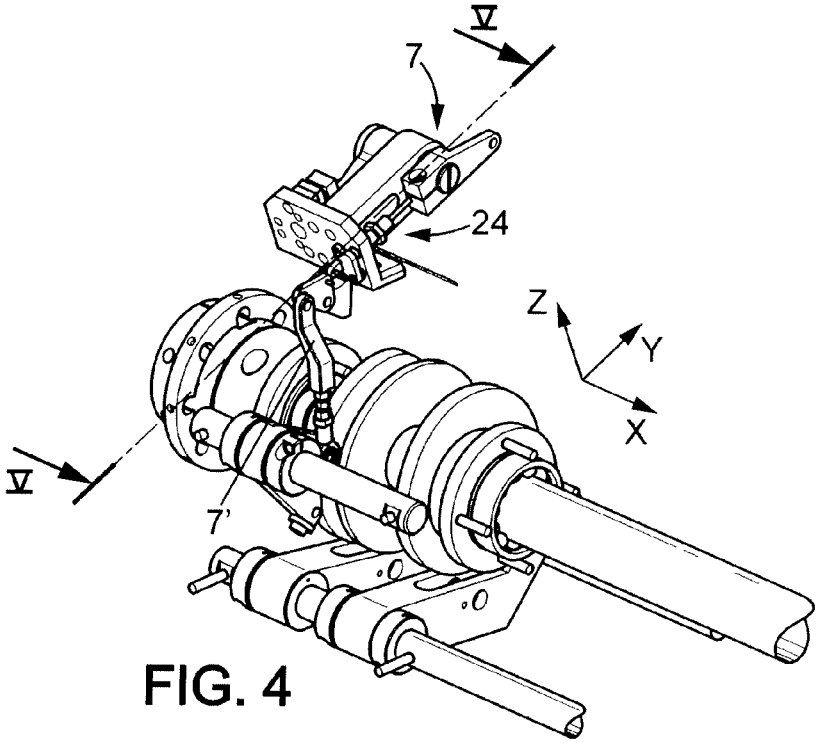
FIG. 4 is a perspective detailed view showing a notching station of the apparatus of FIG. 1.
Figure 5:
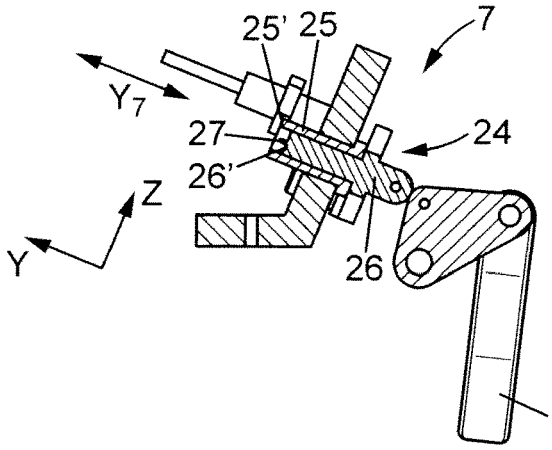
FIG. 5 is a partial cross sectional view along line V-V of FIG. 4 of the notching apparatus.
Figure 20:
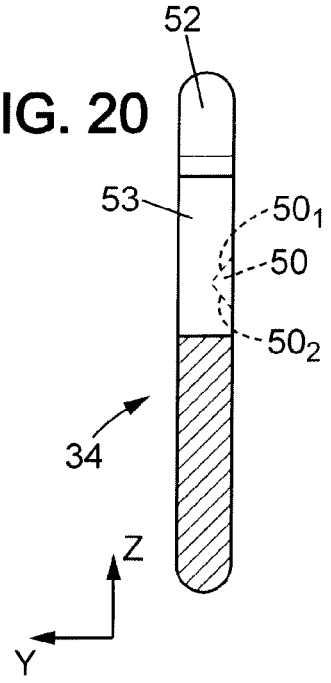
FIG. 20 is a sectional view along line XX-XX on FIG. 21, of the strip exiting the notching station.
Figure 21:
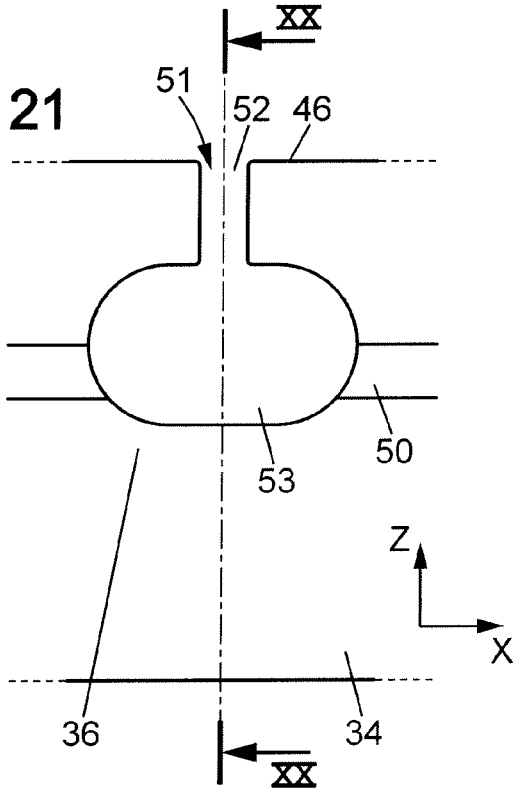
FIG. 21 is a planar view of a part of the strip exiting the notching station.

The strip is then moved along the path 2 to the straightening station 6 which has been previously described and then to the notching station 7 shown on FIG. 4. The actuator 7' is adapted to cause a notching device 24 to generate a notch through the strip 34 at a given rhythm. According to the present embodiment, this rhythm is selected so that a future individual blade support 134 will extend between two consecutive notches 51 in the strip. As seen on FIG. 5, the notching device 24 will comprise a cylindrical seat 25 having an end 25' facing one of the faces 48, 49 of the strip (for example the face 48), and a piston 26 slidable with respect to the seat 25 along direction Y7 in a back and forth movement actuated by the actuator 7'. The piston 26 comprises, at a notching head 26', a notching portion 27 adapted to perforate through the strip 34 where it is situated. As seen on particular on FIGS. 20 and 21, the notch 51 will extend throughout the thickness of the strip 34 between the two faces 48 and 49. It extends from the top side 46 downward, but not reaching up to the bottom side 47. Further, the notch 51 will comprise a top short portion 52 extending from the top side 46 downward and a bottom long portion 53, longer than the short portion 52 along the axis X and extending from the top short portion 52 downward to the intermediate portion 36 of the strip 34.

Figure 6:
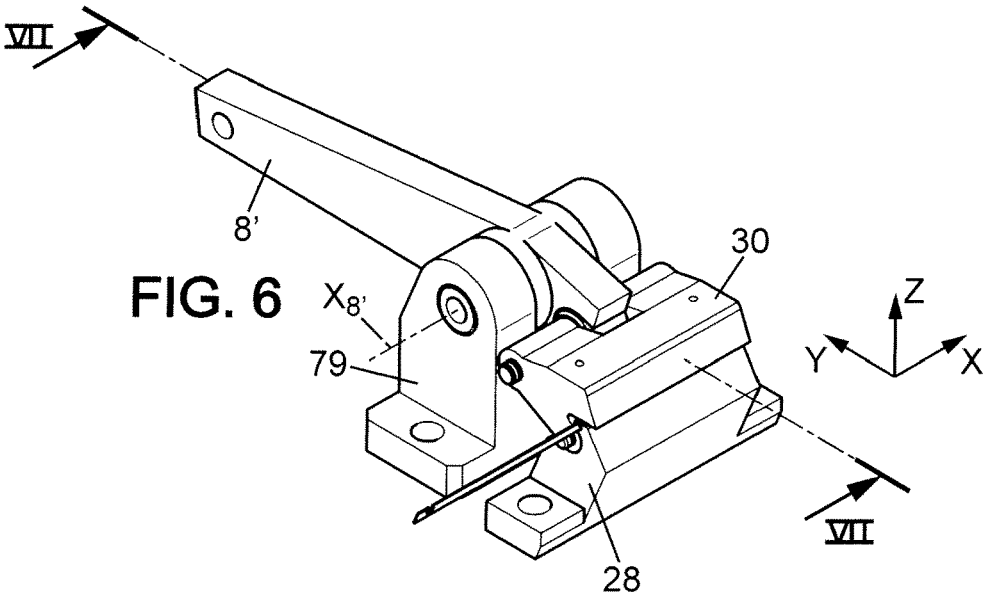
FIG. 6 is a perspective view of a bending station of the apparatus of FIG. 1.
Figure 7:
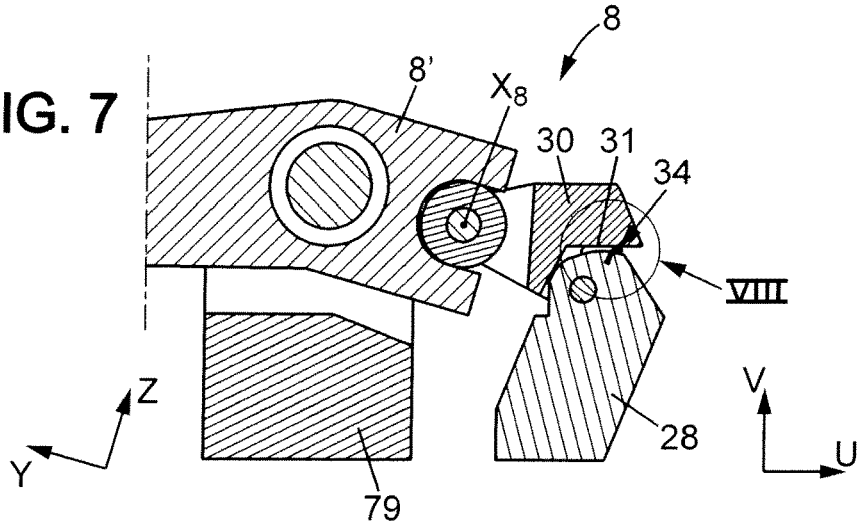
FIG. 7 is a sectional view along line VII-VII of FIG. 6 of the bending station.
Figure 8:
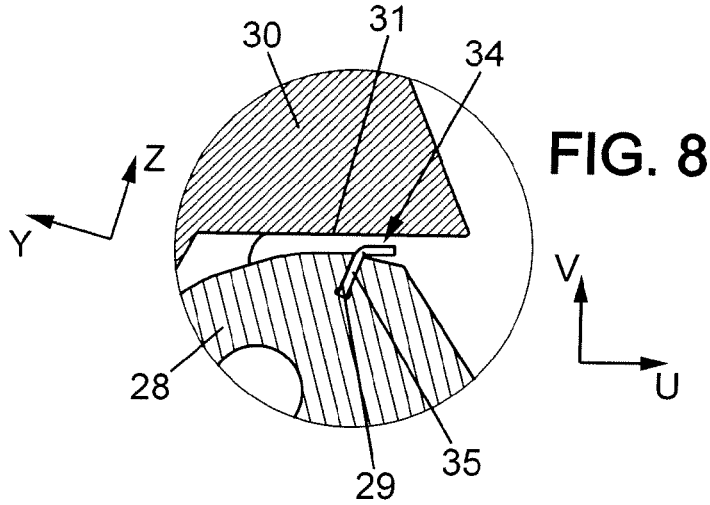
FIG. 8 is an enlarged sectional view of the bending station, as indicated by VIII on FIG. 7.

The strip 34 is then moved to the bending station 8 shown in detail on FIGS. 6 to 8. The bending station 8 comprises a fixed receiving part 28 which comprises a slot 29 which receives the lower portion 35 of the strip 34 (see FIG. 8). The intermediate portion 36 and the upper portion 39 of the strip project outside of the slot 29.

The bending station 8 further comprises a bending tool 30 which is rotatably mounted on the actuator 8' with respect to a rotation axis X8. The actuator 8' is mobile with respect to a support 79 about axis X8' so as to cause the rotation of the bending tool 30 about the rotation axis X8 between a neutral position (not shown) and a bending position, represented on FIG. 7. The length of the bending tool 30 along the axis X (transverse to the plane of FIG. 7) is about the distance separating two notches 51. The bending tool 30 has a bending surface 31 which bears on the strip 34 so as to bend the strip between two successive notches 51 about axis X.

In the present embodiment, the bending is performed so that the face 48 of the strip, which carries the groove 50 will be the inner face of the strip, whereas the outer face 49 will be the outer face. However, in an alternative embodiment, a bending could be performed with the groove 50 on the outer face of the strip. The bending is performed mainly at the intermediate portion 36 of the strip 34, so that the lower portion 35 remains substantially flat, and the upper portion 39 thereof also remains substantially flat, and angled with respect to the lower portion by an angle of about 60-76 degrees (about) 68°. The resulting portion of the strip is shown on FIG. 22.

Figure 22:
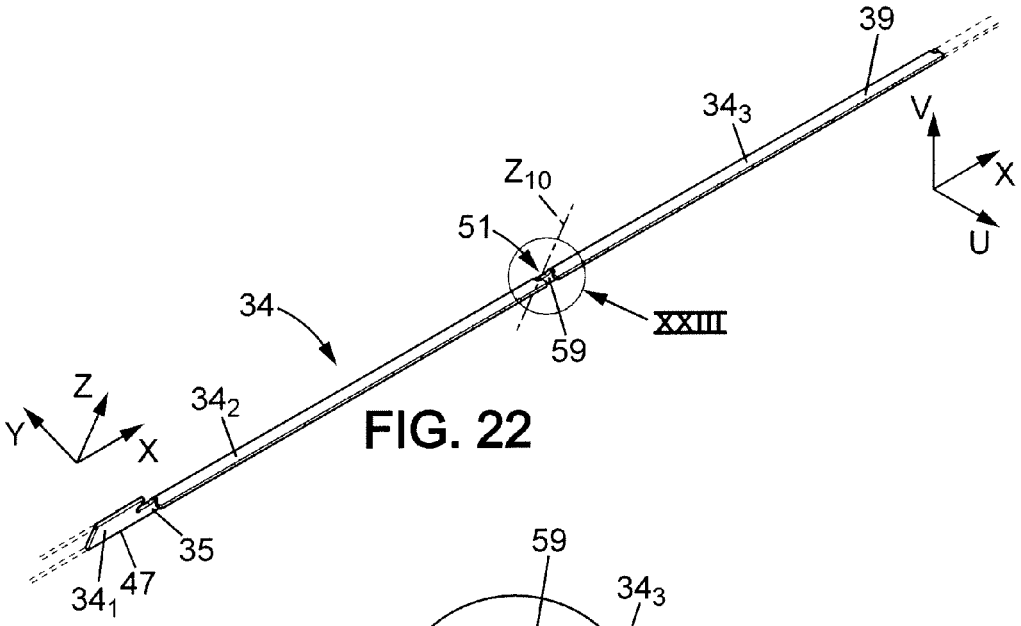
FIG. 22 is a partial perspective view of the strip at the bending station.

FIG. 22 shows a portion of the strip 34, which can be divided in three parts longitudinally along the axis X. The left hand side part 341, which is shown only partially, corresponds to a future blade support having not yet entered the bending station. The central part 342 is a future individual blade support located in the bending station, just after being submitted to the bending action of this station. The right hand side part 343 is a future individual blade support which has recently exited the bending station.

In a variant embodiment, the bending tool 30 could be subjected to a translative back and forth movement with respect to the receiving part 28.

Another frame of reference is used to describe the geometry of the apparatus after the bending station. The longitudinal direction X remains the same as above. The direction U, or depth direction, defines with direction X the plane of the upper surface 73 of the upper portion 39 of the bent strip 34. The direction V is the normal direction to the plane X-U. Thus, at this stage, the notch 51 is also bent, the lowermost portion of the notch 71 remaining in the X-Z plane of the lower portion 35 of the strip, whereas the topmost portion of the notch 51, including the whole of portion 52, is located in the X-U plane of the upper portion 39. The longitudinal groove 50 is almost closed at this stage, its two angled surfaces 501 and 502 facing each other after bending.

Figure 9:
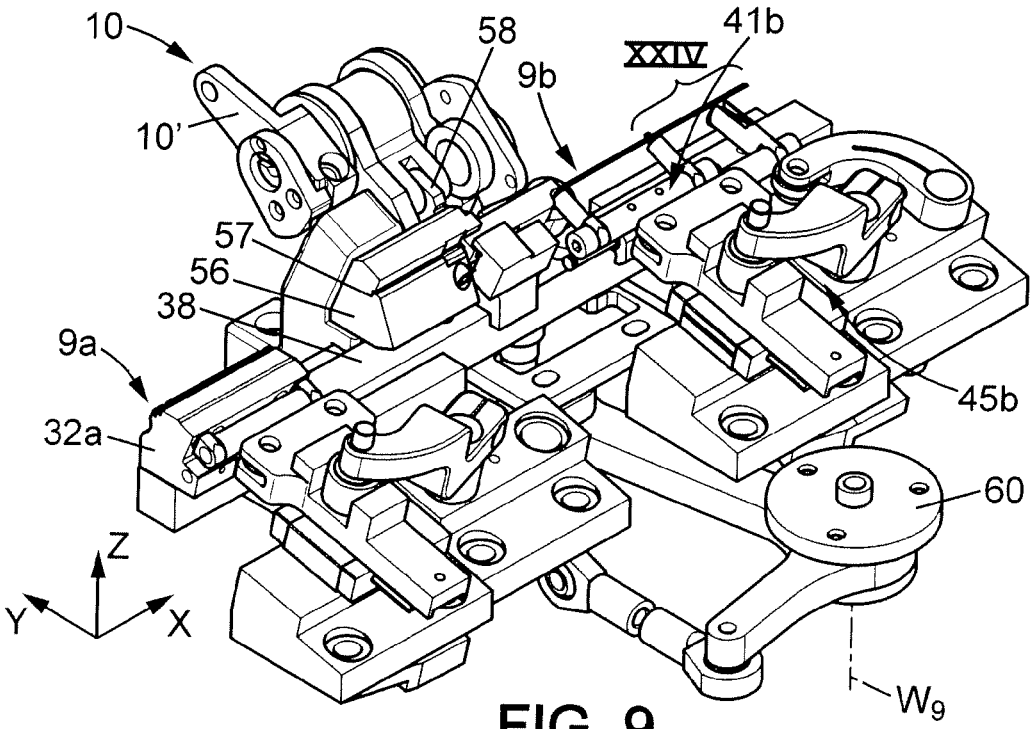
FIG. 9 is a detailed perspective view of a displacement station and of a separation station of the apparatus of FIG. 1.

On FIG. 9 are schematically shown the first displacement post 9*a*, the separation station 10 and the second displacement post 9*b*.

The first displacement post 9*a* comprises a grooved base 32*a* which comprises a groove 33 (see FIG. 11) in which the lower portion 35 of the strip is disposed, and aligned with the slot 29 of the receiving part 28 of the bending station (see FIG. 8), along axis X. The base 32 is made to move along the axis X9*a* in a back-and-forth movement identified by arrow 37 on FIG. 10 on a receiving rail 38, which is fixed. Further, the base 32 has longitudinal holes 40 extending along direction Y. A connection device 41*a* comprises a longitudinal body 42 and two side arms 43 (see FIG. 11) each extending in respective hole 40 of the base 32*a*. Each of these arms 43 has, at its end, an end pin 44 of a shape complementary with the notch 51 of the bent portion of the strip and in particular, with its bottom long portion 53. The connection device 41 is slidably mounted on the base 32*a* along direction Y9*a* and can be submitted by an actuator to a back-and-forth movement along direction Y9*a* between a position in which the end pin (guiding device) 44 extends in the notch (guided portion) 51 of the strip, thereby connecting together the base 32*a* and the strip 34, and a second position where the end pin 44 is removed from the notch 51 of the strip.

Figure 10:
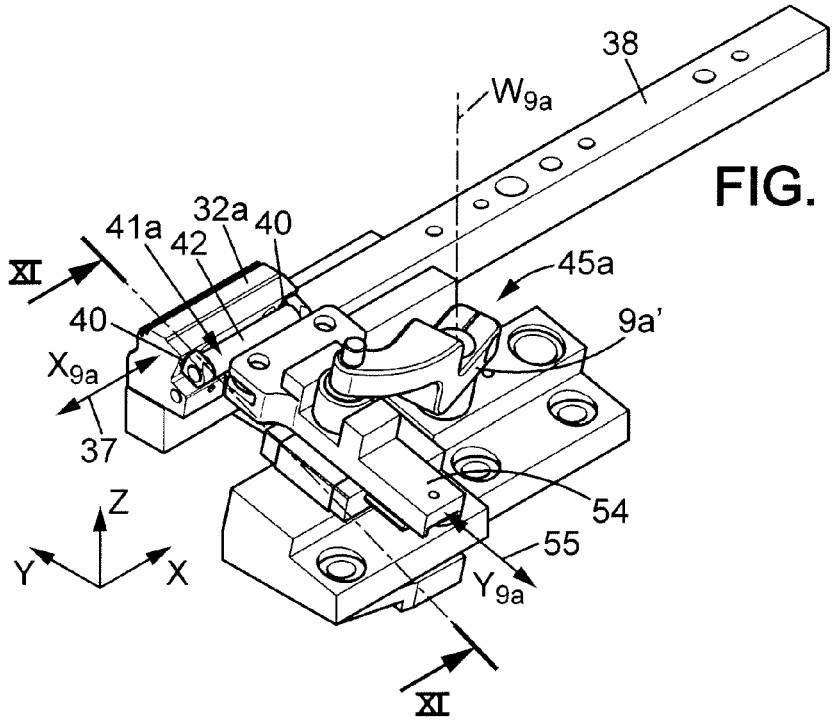
FIG. 10 is a perspective partial view of FIG. 9.
Figure 11:
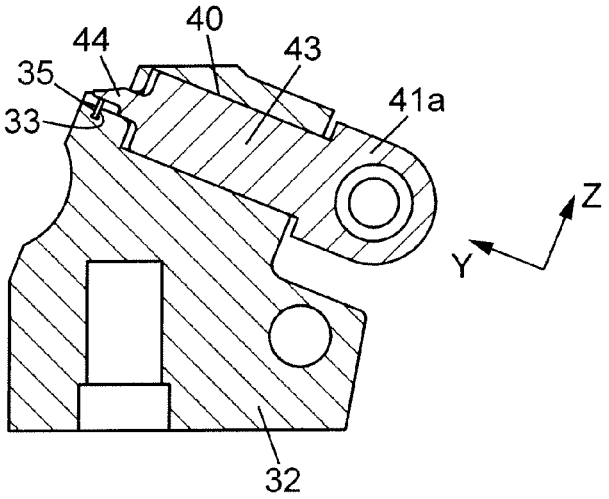
FIG. 11 is a partial sectional view along line XI-XI of FIG. 10.

As can be seen in particular in FIG. 10, the actuator 45*a* can comprise an actuating arm 54 which is adapted to perform a back-and-forth movement along direction Y9*a*, as shown by arrow 55, for example actuated by a rotative arm 9*a*' rotative about the axis W9*a*. The actuating arm will alternately press on the longitudinal body 42 to have the end of the arms 43 enter the notches 51, or release the body. The actuating arm 54 will be sufficiently long along direction X so as to impart the required movement along direction Y to the connection device 41*a* all along the displacement stroke of this device along direction X9*a*. Upon operation, the end pin 44 will be moved along direction Y9*a* into two successive notches 51 of the strip 34. Then, the base 32 will be moved along rail 38 along direction X9*a*, thereby carrying the strip along direction X9*a* by one stroke, corresponding to the spacing between two successive notches. Then, the arms 43 of the connecting device 41*a* will be submitted to an opposite movement along direction Y9*a* so as to free the strip from the base 32*a*, and the base 32*a*, will be moved in the opposite direction back to its initial position without carrying the strip 34.

Figure 23:
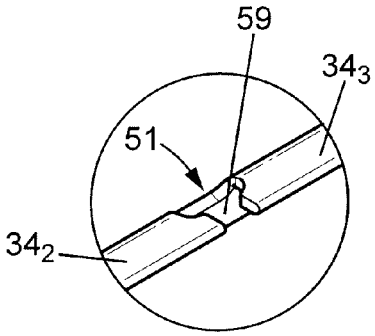
FIG. 23 is an enlarged view of a part of FIG. 22, FIG. 24 schematically shows in perspective a support exiting the separation station.

As shown back on FIG. 9, the strip is thus moved to the separation station 10 which comprises a grooved base 56 stationarily mounted on the rail 38, which comprises a groove 57 of similar shape, which receives therein the lower portion 35 of the strip, and a cutting device 58 which can be actuated by the actuator 10' so as to cut the strip when required. A separation portion 59 of the strip is defined, as shown on FIG. 23 by dotted lines between two supports, extending from the middle (along direction Z 10) of the bottom portion of the notch 51 downwards until the bottom side 47 of the strip. The cutting device 58 is thus synchronized with the apparatus to separate individual supports 134 from the strip 34 at the notch 51, by breaking the separation portion 59. The individual support 134 resulting from this cutting operation can be seen on FIG. 24.

Figure 24:
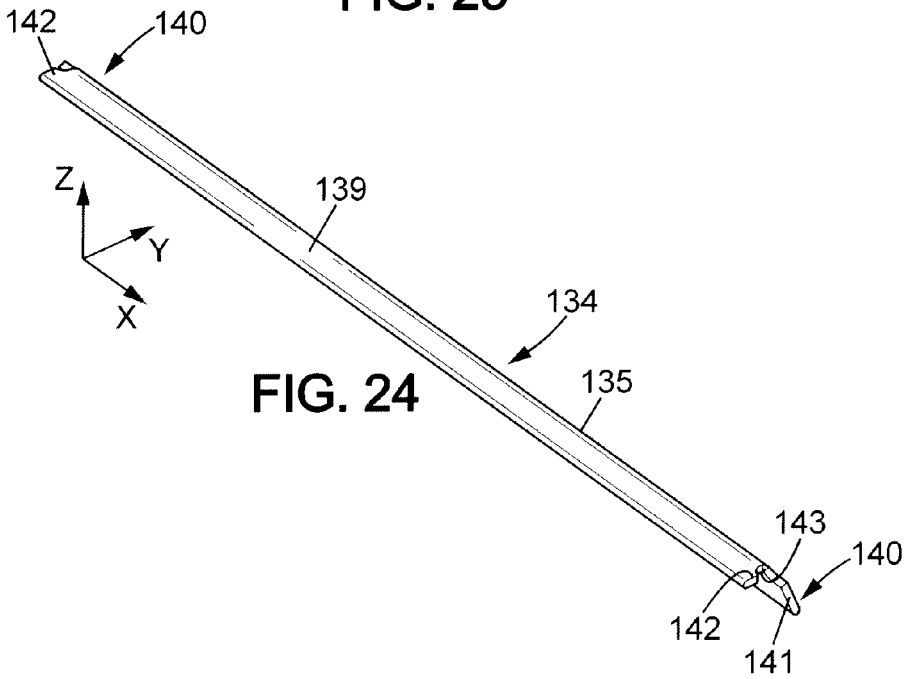

FIG. 24 shows a perspective view of an individual support.

The individual bent support 134 comprises:

a substantially flat lower portion 135, and a substantially flat upper portion 139.

The lower portion 135 of the bent support 134 extends longitudinally between two lateral portions 140. Each lateral portion includes a side edge 141 obtained at the separation station 10.

The upper portion includes a side edge obtained at the notching station. The upper portion 139 of the bent support extends longitudinally between two lateral edges each including a rounded protrusion 142, which is constituted by a lateral wing with rounded angles protruding laterally from the upper portion 139.

Further, a rounded indent 143 separates the rounded protrusion 142 from the lateral edge 141 of the lower portion.

Thus, the side edges 141 of the lower portion of the bent support protrude laterally from the rounded protrusions 142.

The individual support 134 which is released from the strip of material 34 at the separation station 10 is, at this stage, handled alone by a second displacement post 9*b*, partly visible on FIG. 9 (see FIG. 12), which is similar to the first displacement post 9*a*. It thus also comprises a grooved base 32*b* similar to the grooved base 32*a*, having a groove which receives the lower portion 135 of the individual support and a similar mechanism of connecting device 41*b* and actuator 45*b*. Further, the first and second displacement posts can be synchronized by operation of a common disk 60 rotating about rotation axis W9.

The base 32*b* displaces the individual support 134 along direction X to an assembly station 12 at which the individual support 134 is assembled to an individual corresponding razor blade 66, visible on FIG. 12. The assembly station 12 comprises a grooved base 61 having a groove similar to the previously described grooves which receive the lower portion 135 of the individual support 134.

As shown on FIG. 13, individual razor blades 66 are provided from a blade delivery station 11 which for example comprises a stack of blades.

Figure 14:
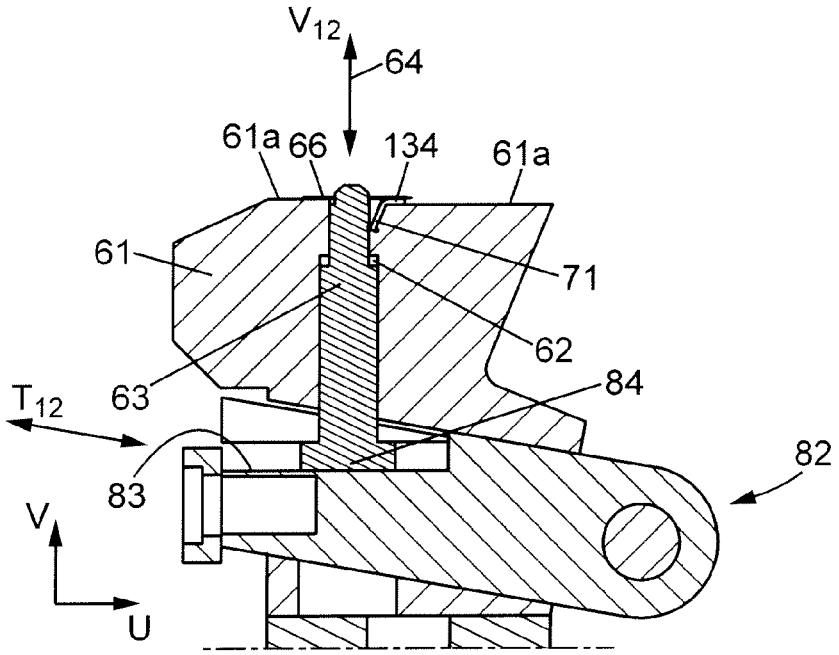
FIG. 14 is a sectional view along line XIV-XIV in FIG. 13.

As shown on FIG. 14, the base 61 comprises a flat receiving surface 61*a* which extends parallel to the U-X plane, and thus receives the upper portion of the support 134.

The grooved base 61 further comprises holes 62 which extend along the direction V and are suitable for receiving blade location pins 63. The blade location pins 63 can be actuated by an actuation mechanism 12' in a back-and-forth movement along direction V12, as shown by arrow 64 on FIG. 14. As shown on FIG. 12, the actuation mechanism 12' comprises an actuation arm 81 which is rotatable about axis W12 to actuate a pin actuation device 82 which is slidable, with respect to the base 61 along a displacement axis T12 in a back-and-forth movement, and has a connection surface 83 engaged with a complementary surface 84 of the blade locating pin to generate the movement of the blade locating pin 63 along axis V12. For example, the blade location pin 63 is also rotated in a cam movement about axis V12 during its movement up and down.

Figure 15:
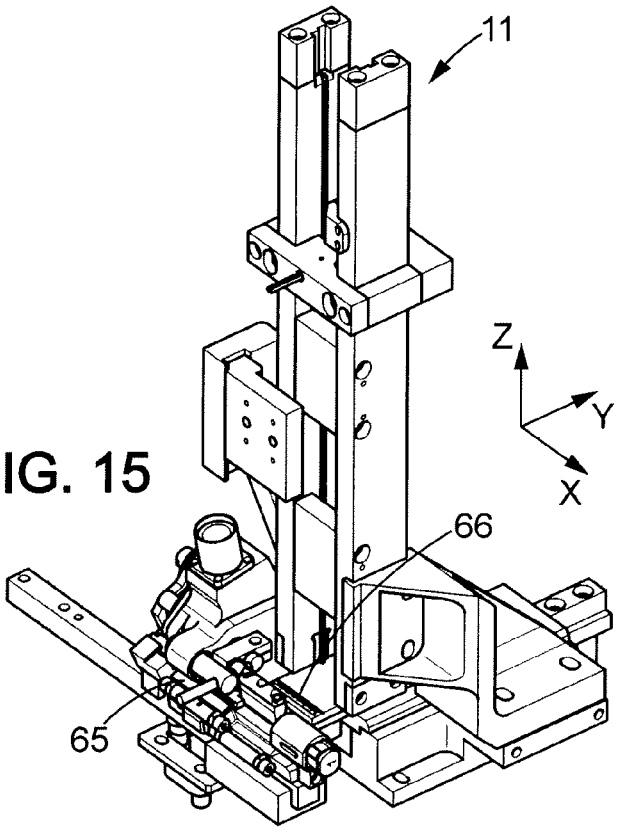
FIG. 15 is a perspective view of an assembling station of the apparatus of FIG. 1.

As shown on FIG. 15, the blade delivery station 11 comprises a pick-and-place apparatus 65 adapted to pick a razor blade 66 from a delivery station and to place it on the grooved base 61, for example using vacuum. Although this is not visible on any figure, vacuum can also be provided in the grooved base 61, through holes extending parallel to the holes 62 which receives the blade location pins 63, to maintain the blade 66 in position.

Coming back to FIG. 13, the individual blade 66 comprises a front head portion 67 comprising a front edge 68, and a back handling portion 69. The back portion has parallel upper 69*a* and lower 69*b* faces. The lower face 69*b* is placed on the receiving surface 61*a* of the base 61. The back portion 69 is provided with two locating holes 70, which are for example located on both lateral sides of the blade 66. The geometry of the locating holes 70 is complementary to the geometry of the blade location pins 63. As shown on FIG. 14, in operation, the blade 66 is precisely located with respect to the individual blade support 134 by the fact that the position of the groove 71 of the base 61, which receives the individual support 134, and the position of the blade location pins 63 are precisely relatively known. The blade 66 is precisely placed with its front portion 67 on the top surface of the platform portion of the support by the insertion of the locating holes 70 of the blade on the blade locating pins 63. The lower face 228 of the front portion 67 of the blade provides a fixation portion resting on the top face of the upper portion of the support 134.

Figure 16:
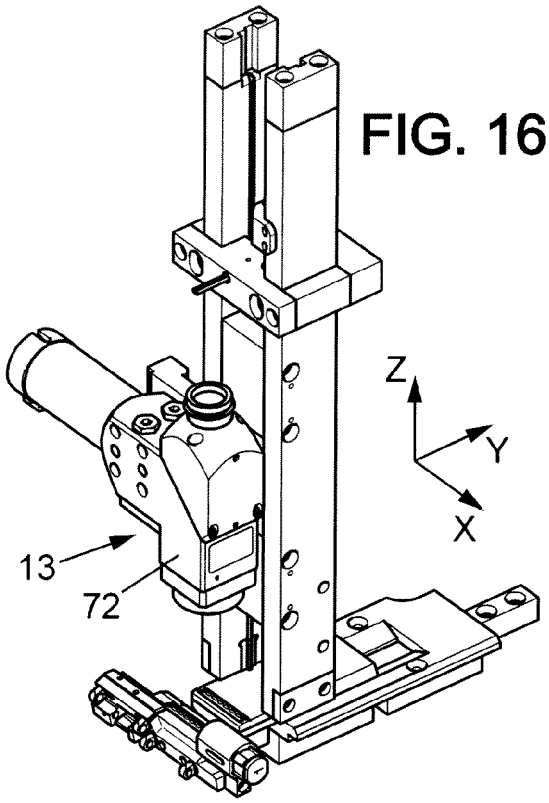
FIG. 16 is a perspective view of a bonding station for the apparatus of FIG. 1.

At this stage, as seen on FIG. 16, the blade and the blade support are located in the bonding station 13 which comprises means to permanently bind together the razor blade and the individual razor blade support 134. For example, a laser 72 is used to assemble, by spot laser welding, the razor blade and the individual blade support 134 lying beneath at the bonding station 13.

FIG. 25 is a cross sectional view of the assembly 80 of a blade 66 and a blade support 134 at this stage. The blade 66 has a front portion 67 which comprises a lower face 228 and a top face 227, substantially flat in a back portion, and which taper (comprising facets 231, 232), converging to a cutting edge 226. The lower face 228 of the blade is in contact with the upper face 73 of the upper portion 139 of the individual support 134 and is fixed thereto by a spot weld 74. The facets extend beyond the edge 146 of the support.

Figure 17:
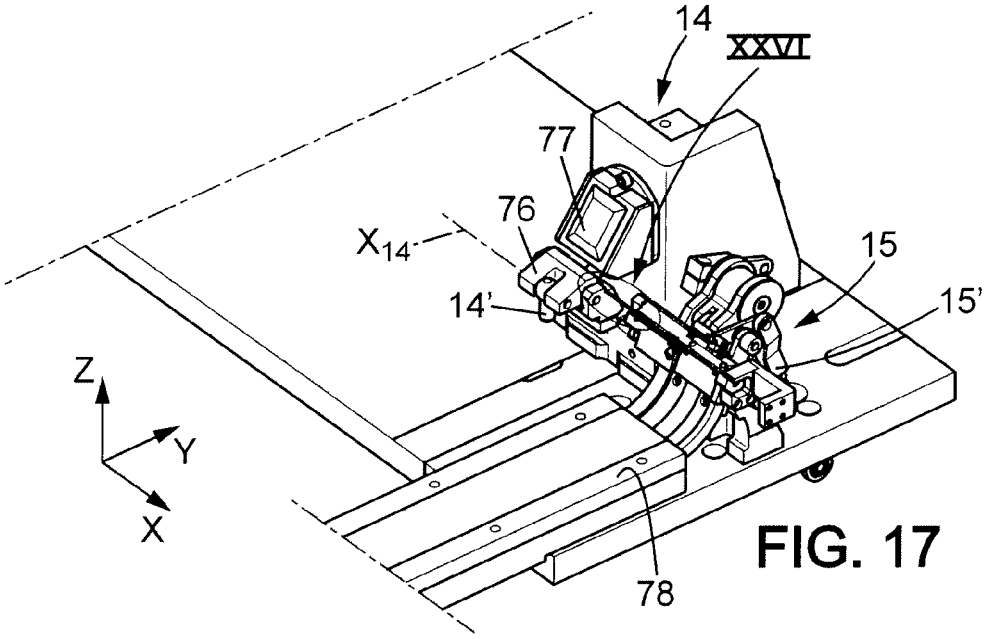
FIG. 17 is a perspective view of a breaking station and a stacking station for the apparatus of FIG. 1, FIG. 18 schematically shows in perspective a part of a strip exiting from the delivery station.

As shown on FIG. 17, the assembly 80 of the individual blade 66 and the individual support 134 is pushed along direction X to the next breaking station 14 by a next individual support moved to the bonding station 13 by the second displacement post 9*b*.

The breaking station 14 is adapted to break the back portion 69 of the blade 66 so as to release a cutting member 124 consisting of the assembly of the individual support 134, and a cutting blade 125 sensibly corresponding to the front portion 67 of the blade 66. The breaking station 14 thus comprises a breaking tool 76 which can be submitted to a rotational movement about axis X14 by actuation of the actuator 14' so as to break the back portion 69 of the blade 66 away from the assembly. An aspiration device 77 can be provided to aspire these back portions 69 to scrap.

Figure 31:
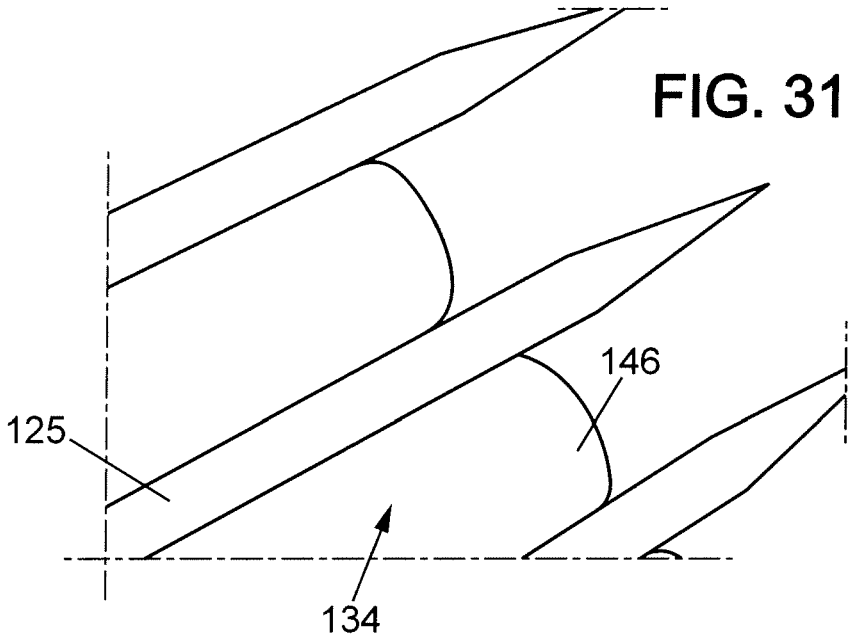
FIG. 31 is an enlarged view of assemblies of blades and their supports.

The resulting cutting member 124 is shown on perspective on FIGS. 26 and 27, and the blade-carrying extremity is shown in enlarged view (microscopic view on scale) on FIG. 31. It comprises the individual support 134 having a lower portion 135, an upper portion 139 bent with respect to this lower portion at an intermediate portion (not visible) which comprises a longitudinal notch on its inner face. It further comprises a razor blade 125. The blade 125 is, in its flat portion, about 0.1 mm thick (for example between 0.04 (preferably 0.09) and 0.11 mm thick) and about 1.3 mm long along axis U from its cutting edge 126 to its opposite back edge (for example between 1.1 and 1.5 mm). The part, along axis U, of the blade, which is in contact with the top surface of the upper portion 139 of the blade support is about 0.77 mm+/−0.15 mm long. In this way, a good retention of the blade on the support is ensured. The cutting edge 126 is at least 0.35 mm away from the front edge 146 of the support, so that the support does not hinder the shaving performance of the neighbouring razor blades. The upper and lower faces 127, 128 of the blade include respectively the two parallel main surfaces 129, 130 and two tapered facets 131, 132 which taper towards the cutting edge 126.

Besides, the upper portion 139 of the bent support extends longitudinally between two lateral edges each including the rounded protrusion 142 which is constituted by a lateral wing with rounded angles protruding laterally from the upper portion 139 and from a corresponding lateral end 133 of the blade.

Further, the rounded indent 143 cut out, as at cut out 150, from the sheet metal forming the blade support, separates the rounded protrusion 142 from the lateral edge 141 of the lower portion 135.

The side edges 141 of the lower portion of the bent support protrude laterally from the lateral ends 133 of the blade and from the rounded protrusions 142.

The resulting cutting members 124 are displaced to a stacking station 15 (see FIG. 17) where they are stacked in a bayonet 78 for use in a razor head assembly process, for the manufacture of a razor head.

In a variant embodiment of such an apparatus, the separation station 10 could be provided after the bonding station 13, or after the breaking station 14, before the stacking station 15.

In a variant embodiment of such an apparatus, one or more of the stations are not necessarily provided in line with the rest of the apparatus. For example, a first part of the process could be performed on a strip which is delivered by a delivery station such as a delivery station 3 of FIG. 1, and rewound to a winding station. The reel carrying the partly formed strip could be then moved to a second apparatus for performing the other steps of the manufacturing process. This could, for example, be the case of the groove forming step.

Thus, the above description of the process of handling the strip, forming the support from the reel, and attaching the razor blade to the support are illustrative only.

Figure 28:
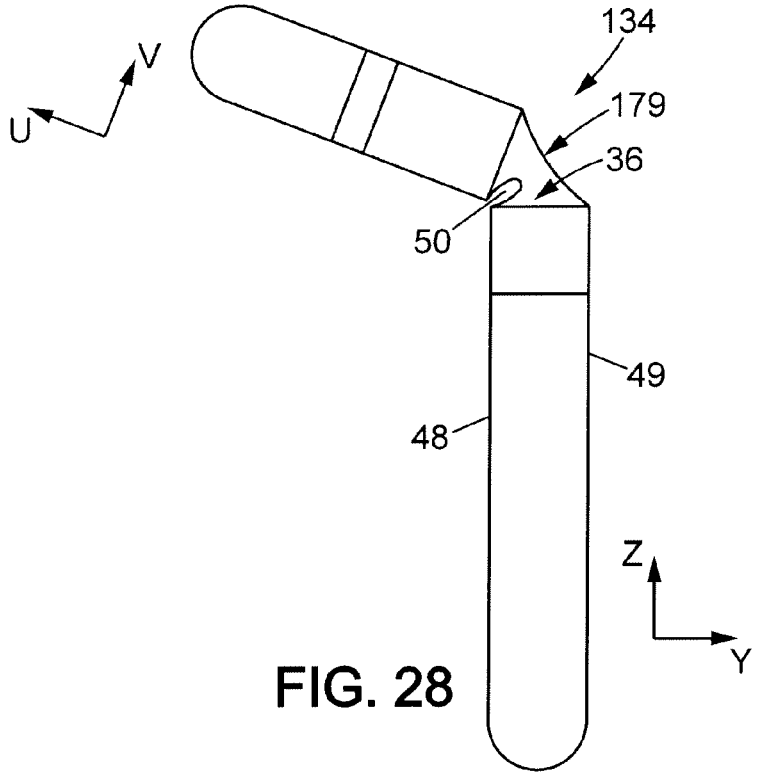
FIG. 28 is a sectional view of a blade support according to a second embodiment.

The above description provides with a first embodiment of a blade support. According to a second embodiment, as shown on FIG. 28, the blade support 134 differs from the previously described support in that it might comprise a recess 179 on the external face 49 in the intermediate bent portion 36. This recess could have a concave shape. This recess could be provided in addition to the groove 50 formed in the inner face 48. According to another embodiment, there might not even be such a groove 50. The recess 179 might for example be manufactured at the groove-forming station 6, by forming a groove similar to the groove 51 on the other side 49 of the strip, either by material slitting or pressing, either simultaneously or with rollers shifted along the X axis.

Figure 29:
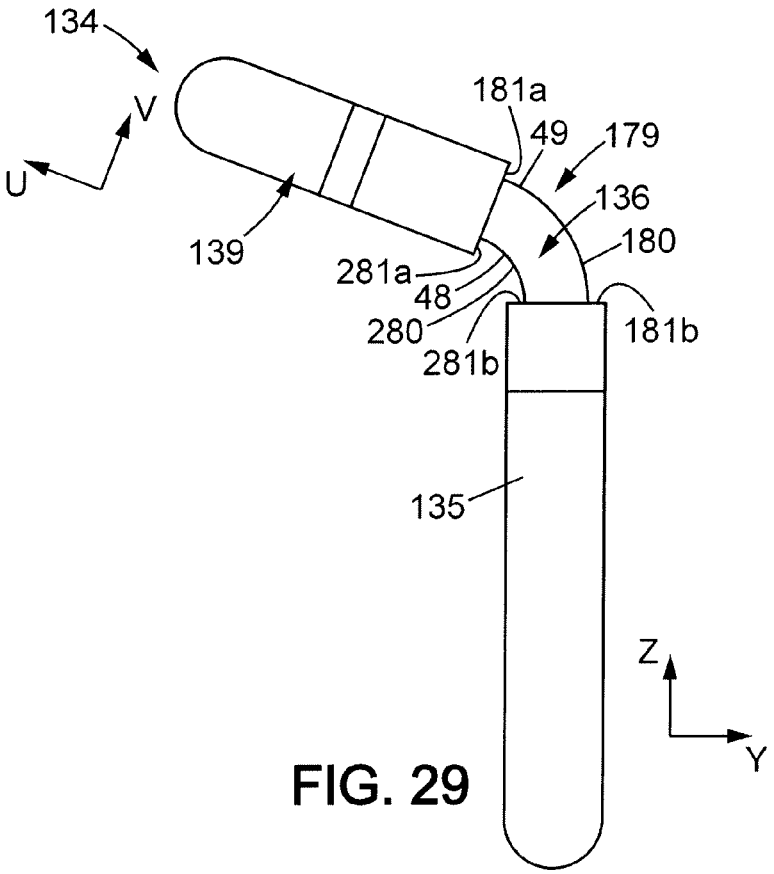
FIG. 29 is a sectional view of a blade support according to a third embodiment.

FIG. 29 shows yet another embodiment for a blade support 134 according to the invention. According to this embodiment, the intermediate portion 36 is performed as a hinge between the top portion 139 of the support and the lower portion 135 of the support. For example, the inner face 48, at the intermediate bent portion 136 has a radius of curvature of about 0.2 mm and the outer face 49 has a convex radius of curvature of about 0.38 mm. The hinge could be performed at the groove-forming station as described above in relation to the embodiment of FIG. 28. Hence, the recess on the outer face 49 has a U-shaped cross-section, having a base 180 from each end of which extends a wing 181*a*, 181*b*, respectively connected to the outer face 49 of the top portion 139 and the bottom portion 135 of the support. A similar geometry 280, 281*a*, 281*b*, with a convex base, can be found on the inner face 49.

Figure 30:
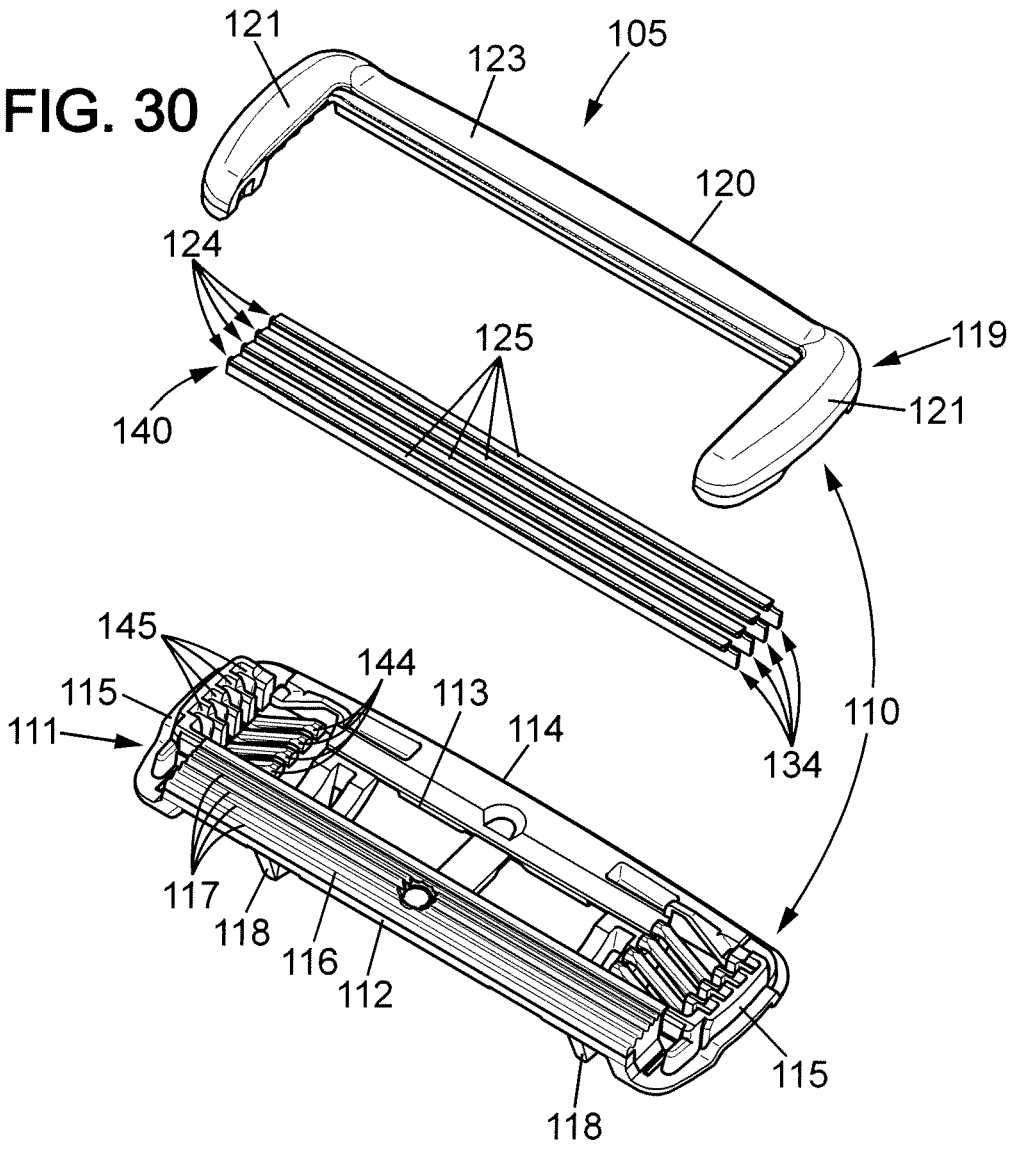
FIG. 30 is a perspective exploded view of an example of a razor head.

FIG. 30 shows a blade unit 105 for a safety razor (also called wet shaver), i.e. a shaver the blades of which are not driven by a motor relative to the blade unit.

Such shavers typically include a handle (not shown) extending in a longitudinal direction wherein the longitudinal direction is defined between a proximal portion and a distal portion bearing the blade unit 105 or shaving head. The longitudinal direction may be curved or include one or several straight portions.

The blade unit 105 includes an upper face equipped with one or several cutting members 124 and a lower face which is connected to the distal portion of the handle by a connection mechanism. The connection mechanism may for instance enable the blade unit 105 to pivot relative to a pivot axis which is substantially perpendicular to the longitudinal direction L. The connection mechanism may further enable to selectively release the blade unit for the purpose of exchanging blade units. One particular example of connection mechanism usable in the present invention is described in document WO-A-2006/027018, which is hereby incorporated by reference in its entirety for all purposes.

As shown in FIG. 30, the blade unit 105 includes a frame 110 which is made solely of synthetic materials, i.e. thermoplastic materials (polystyrene or ABS, for example) and elastomeric materials.

More precisely, the frame 110 includes a plastic platform member 111 connected to the handle by the connection mechanism and having:

a guard 112 extending parallel to the pivot axis, a blade receiving section 113 situated rearward of the guard 112 in the direction of shaving, a cap portion 114 extending parallel to the pivot axis and situated rearward of the blade receiving section 113 in the direction of shaving, and two side portions 115 joining the longitudinal ends of the guard 112 and of the cap portion 114 together.

In the example shown in the figures, the guard 112 is covered by an elastomeric layer 116 forming a plurality of fins 117 extending parallel to the pivot axis.

Further, in this particular example, the underside of the platform member 111 includes two shell bearings 118 which belong to the connection mechanism and which may be for example as described in the above-mentioned document WO-A-2006/027018.

The frame 110 further includes a plastic cover 119. The cover 119 exhibits a general U shape, with a cap portion 120 partially covering the cap portion 114 of the platform and two side members 121 covering the two side members 115 of the platform. In this embodiment, the cover 119 does not cover the guard 112 of the platform.

The cap portion 120 of the cover 119 may include a lubricating strip 123 which is oriented upward and comes into contact with the skin of the user during shaving. This lubricating strip may be formed for instance by co-injection with the rest of the cover.

Referring back to FIG. 27, at least one cutting member 124 is movably mounted in the blade receiving section 113 of the platform. The blade receiving section 113 may include several cutting members 124, for instance four cutting members as in the example shown in the drawings.

Each cutting member 124 includes a blade 125 with its cutting edge 126 oriented forward in the direction of shaving. Each blade 125 has its upper face 127 oriented towards the skin to be shaved and a lower face 128 oriented toward the handle.

Each blade 125 extends longitudinally, parallel to the pivot axis, between its two lateral ends 133.

Each blade 125 is borne by a respective bent support 134. The bent support 134 comprises:

the substantially flat lower portion 135 (for example substantially perpendicular to the shaving plane), and the substantially flat upper portion 139 which extends parallel to the blade 125.

The angle of the upper portion 139 and of the blade 125 with respect to the shaving plane may be around 22°.

The lower portion 135 of the bent support 134 extends longitudinally, parallel to the pivot axis, between the two lateral portions 140.

As shown in FIG. 30, each cutting member 134 is borne by two elastic fingers 144 which are molded as a single piece with the platform 111 and which extend towards each other and upwardly from both side members 115 of the platform.

Besides, as shown in FIG. 30, the end portions 140 of the bent supports are slidingly guided in vertical slots 145 (i.e. slots which are substantially perpendicular to the shaving plane) provided in the inner face of each side member 115 of the platform.

The blade members 124 are elastically biased by the elastical arms 144 toward a rest position. In this rest position, the upper faces 127 of the blades, at each lateral end of the blades, bear against corresponding upper stop portions which are provided on the bottom face of each side member 121 of the cover, the side member 121 covering the slots 145 (not visible).

Therefore, the rest position of the blade members 124 is well defined, therefore enabling a high shaving precision.

The invention claimed is:

1. A method comprising:

providing at least one elongated strip of material, the at least one elongated strip of material extending along a first direction, the first direction defining a length of the elongated strip, the at least one elongated strip of material including a first portion including a first extremity, a second portion including a second extremity, and an intermediate portion disposed between the first and second portions;

rounding the first extremity and the second extremity such that the rounding of the first extremity and the second extremity allows for the first extremity and the second extremity to be burr free;

bending the intermediate portion about a bending axis to form the at least one elongated strip of material into a blade support;

providing at least one razor blade; and fixing the at least one razor blade onto the first portion of the blade support.

2. The method according to claim 1, prior to the step of bending and further comprising the steps of:

forming a plurality of consecutive notches in the at least one elongated strip of material, the notches being formed in the first portion, transverse to the first direction.

3. The method according to claim 2, further comprising:

prior to the step of bending and after the step of forming the plurality of consecutive notches, forming a separation portion in the second portion, the separation portion extending from a middle of a bottom of each of the plurality of consecutive notches towards the second extremity; and after the step of bending, separating the blade support, wherein the step of separating includes breaking the blade support at the separation portion.

4. The method according to claim 2, wherein the step of forming the plurality of consecutive notches involves spacing the plurality of consecutive notches along the at least one elongated strip of material, and extending each one of the plurality of consecutive notches from the first extremity toward the second extremity such that each one of the plurality of notches is disposed in both the first portion and the intermediate portion.

5. The method according to claim 4, further comprising after the step of bending:

separating the blade support at each one of the plurality of consecutive notches.

6. The method according to claim 5, wherein the step of separating is performed before the step of fixing, the step of separating involves separating the blade support to form a plurality of blade supports, the at least one razor blade being a plurality of razor blades, and the step of fixing further comprises fixing each one of the plurality of razor blades onto the first portion of each one of the plurality of blade supports.

7. The method according to claim 1, wherein the at least one elongated strip of material is a plurality of elongated strips of material and the at least one razor blade is a plurality of razor blades; and the method further comprising moving the plurality of elongated strips of material along a process path, and as each one of the plurality of elongated strips of material moves along the process path, repeating at least the steps of bending each one of the plurality of elongated strips of material to form a plurality of blade supports and fixing at least one of the plurality of razor blades to each one of the plurality of blade supports.

8. The method according to claim 7, wherein the process path is defined at least from the step of bending to the step of fixing, after repeating the step of bending and prior to repeating the step of fixing, the method further comprising repeating the step of separating the blade support to form the plurality of blade supports.

9. The method according to claim 1, wherein the bending axis extends parallel to the first direction.

10. The method according to claim 1, wherein after the step of providing the at least one elongated strip of material and subsequent to the step of rounding the first and second extremities but prior to the step of bending, the method further comprises flattening the first, second and intermediate portion of the at least one elongated strip of material along a second direction perpendicular to the first direction, the flattening of the at least one elongated strip of material in the second direction further defining a thickness of the at least one elongated strip of material.

11. The method according to claim 10, wherein after the step of flattening the at least one elongated strip of material along the second direction perpendicular to the first direction, and prior to the step of bending, the method further comprising flattening the strip of material along a third direction, perpendicular to the first and second directions, the third direction defining a height of the at least one elongated strip of material.

12. The method according to claim 1, wherein the step of providing the at least one elongated strip of material includes obtaining a wire that has been previously flattened to form the at least one elongated strip of material; and the step of bending includes forming the flattened wire of the at least one elongated strip of material into the blade support.

13. The method according to claim 12, wherein the flattened wire of the at least one elongated strip of material has a thickness of 0.22 and 0.32 mm, preferably between 0.265 and 0.295 mm.

14. The method according to claim 12, wherein prior to the step of providing the at least one elongated strip of material, the flattened wire of the at least one elongated strip of material is formed by cold rolling.

15. The method according to claim 12, wherein the flattened wire of the at least one elongated strip of material is flattened by cold rolling and prior to the step of providing the at least one elongated strip of material, the at least one elongated strip of material undergoes a second flattening process, along a second direction perpendicular to the first direction, the second direction defining a thickness of the at least one elongated strip of material, and the second flattening process thereby leading to the rounding step wherein the first and second extremities are rounded to be burr free.

* * * * *